US009077123B2

(12) United States Patent
Ma

(10) Patent No.: US 9,077,123 B2
(45) Date of Patent: Jul. 7, 2015

(54) ELECTRICAL CONNECTOR ASSEMBLY WITH LOW PROFILE

(71) Applicant: Hon Hai Precision Industry Co., Ltd., New Taipei (TW)

(72) Inventor: Hao-Yun Ma, San Jose, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 55 days.

(21) Appl. No.: 14/073,828

(22) Filed: Nov. 6, 2013

(65) Prior Publication Data

US 2015/0126050 A1 May 7, 2015

(51) Int. Cl.

| | |
|---|---|
| ***H01R 12/00*** | (2006.01) |
| ***H01R 12/71*** | (2011.01) |
| ***H01R 12/59*** | (2011.01) |
| ***H01R 12/62*** | (2011.01) |
| ***H01R 12/79*** | (2011.01) |

(52) U.S. Cl.

CPC ..... *H01R 12/716* (2013.01); *H01R 9/096* (2013.01); *H01R 12/592* (2013.01); *H01R 12/62* (2013.01); *H01R 12/79* (2013.01)

(58) Field of Classification Search

USPC ..... 439/83, 65, 67, 493, 630, 637

See application file for complete search history.

(56) References Cited

U.S. PATENT DOCUMENTS

| | | | | |
|---|---|---|---|---|
| 5,194,010 | A * | 3/1993 | Dambach et al. | 439/79 |
| 5,217,394 | A * | 6/1993 | Ho | 439/620.21 |
| 5,299,089 | A * | 3/1994 | Lwee | 361/679.33 |
| 5,548,484 | A * | 8/1996 | Kantner | 361/737 |
| 5,709,568 | A * | 1/1998 | Pan et al. | 439/541.5 |
| 5,947,764 | A * | 9/1999 | Pan et al. | 439/492 |
| 6,371,770 | B1 * | 4/2002 | Lai | 439/67 |
| 6,551,131 | B1 * | 4/2003 | Kuo | 439/541.5 |
| 7,147,488 | B2 * | 12/2006 | Chen | 439/79 |
| 7,399,186 | B2 * | 7/2008 | Tsai | 439/74 |
| 7,614,899 | B2 | 11/2009 | Zhu et al. | |
| 2014/0342580 | A1 * | 11/2014 | Hogan | 439/62 |

* cited by examiner

*Primary Examiner* — Neil Abrams
*Assistant Examiner* — Travis Chambers
(74) *Attorney, Agent, or Firm* — Wei Te Chung; Ming Chieh Chang

(57) ABSTRACT

An electrical connector assembly mounted on a printed circuit board, includes a socket and a connector. The socket mounted on the printed circuit board, has an insulative housing with upper body and lower body formed with a receiving room. A number of contacts respectively received in the upper body and lower body with a same structure. The contacts have spring portions extending into the receiving room and soldering portions extending beyond the upper body and the lower body. The connector is mounted on the printed circuit board. A linking element mechanically and electrically connects the socket and the connector.

20 Claims, 6 Drawing Sheets

ELECTRICAL CONNECTOR ASSEMBLY WITH LOW PROFILE

BACKGROUND OF THE INVENTION

1. Field of the Invention

The present invention relates to an electrical connector assembly, and more particularly to a socket with a low profile to electrically connect a connector.

2. Description of Related Art

U.S. Pat. No. 7,614,899 issued to Zhu et al. on Jan. 29, 2008 discloses an electrical connector includes a main board with a first card edge connector mounted thereon, a sub-board with a second card edge connector mounted thereon, and a pair of complementary board to board connectors mounted on the main board and the sub-board respectively. The first and second card edge connectors are aligned with each other in a vertical direction and the second card edge connector is on top of the first card edge connector.

Zhu et al. disclose the electrical connector including the first card edge connector and the second card edge connector which interconnect two card edges in a vertical direction, the two card edges need two receiving rooms that doesn't meet the requirement of low profile.

Therefore, an improved electrical connector assembly is needed.

SUMMARY OF THE INVENTION

An object of the present invention is to provide an electrical connector assembly with a low profile.

According to one aspect of the present invention, an electrical connector assembly mounted on a printed circuit board, comprises a socket mounted on the printed circuit board. The socket has an insulative housing with upper body and lower body to form a receiving room. A plurality of contacts respectively receive in the upper body and lower body with a same structure. The contacts has spring portions extending into the receiving room and soldering portions extending respectively out of a top surface of the upper body and a bottom surface of the lower body. A connector are mounted on the printed circuit board. A linking element mechanically and electrically connects the socket to the connector.

According to another aspect of the present invention, an electrical connector assembly for receiving a card, comprises a socket and a connector. A socket connector includes an insulative housing with a receiving room for electrically connecting two opposite sides of a card. A plurality of contacts with a same structure are disposed in the insulative housing and located in two rows in an up-to-down direction. The contacts extend into the receiving room adapt for connecting the card and extend beyond an upper surface and a lower surface of the insulative housing. A linking element electrically connects the contact beyond the upper surface of the insulative and the connector.

Other objects, advantages and novel features of the invention will become more apparent from the following detailed description of a preferred embodiment when taken in conjunction with the accompanying drawings.

DETAILED DESCRIPTION OF THE INVENTION

Figure 1:
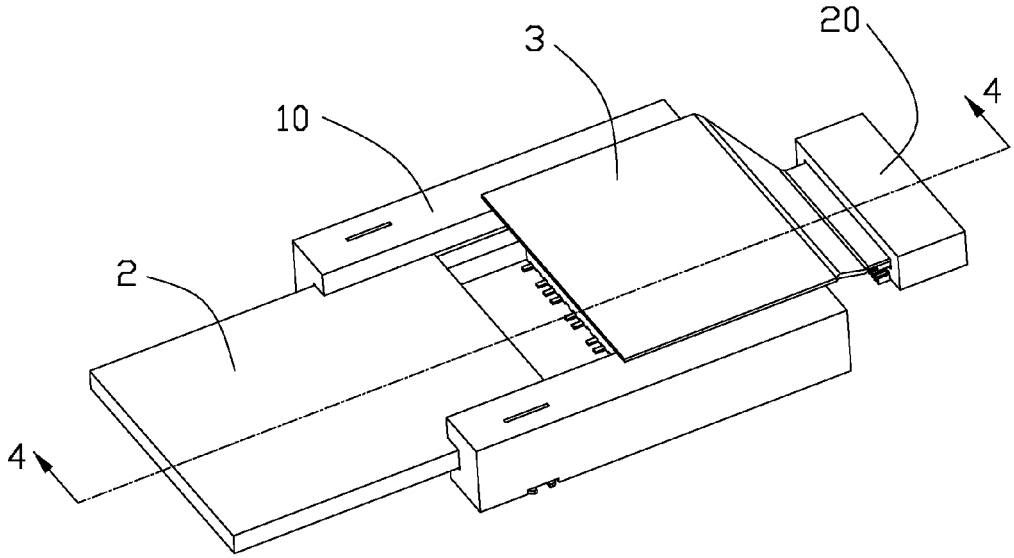
FIG. 1 is an assembled, perspective view of an electrical connector assembly in accordance with the first invention.
Figure 2:
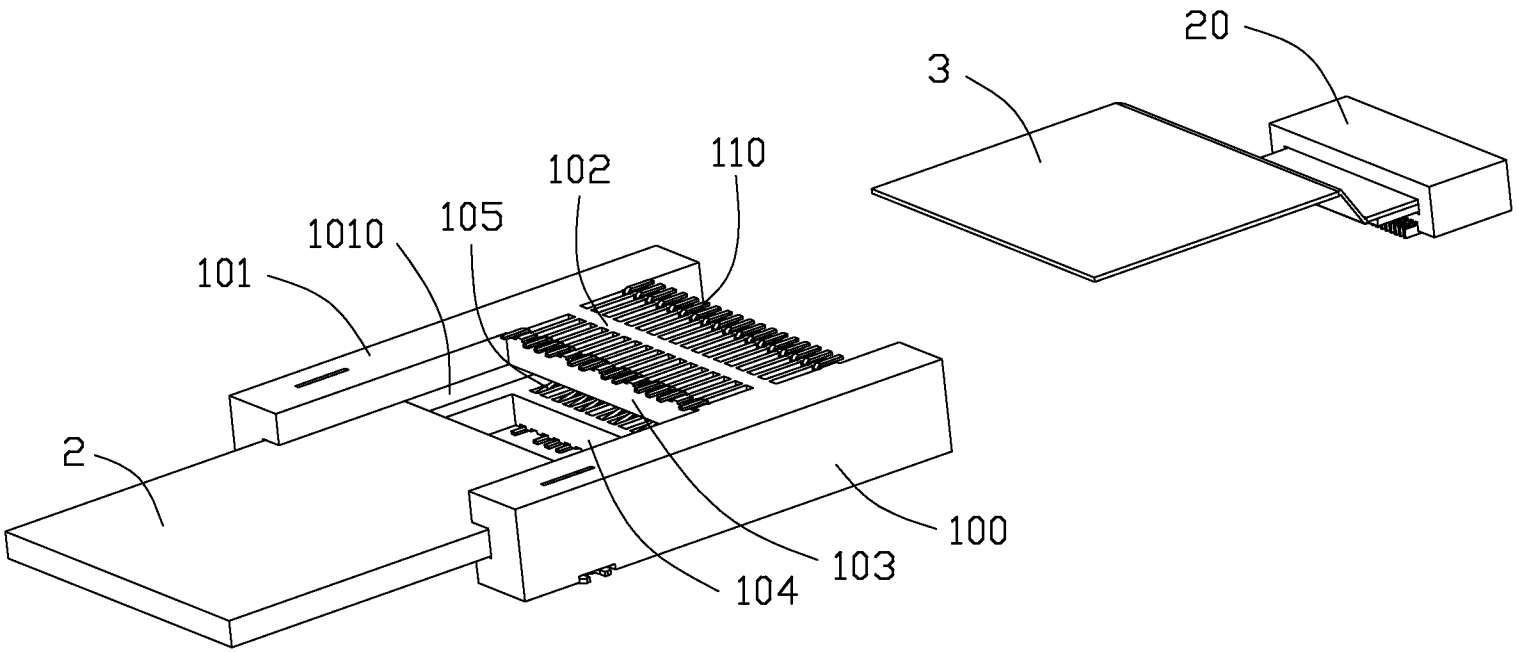
FIG. 2 is an exposed view shown two parts of the electrical connector assembly in FIG. 1.

FIG. 1 and FIG. 2 show an electrical connector assembly in accordance with a first embodiment. The electrical connector assembly includes a socket 10 and a flex cable connector 20 connecting with the socket 10. The socket 10 and the flex cable connector 20 are both soldered to a same printed circuit board 1 (see FIG. 4).

Figure 3:
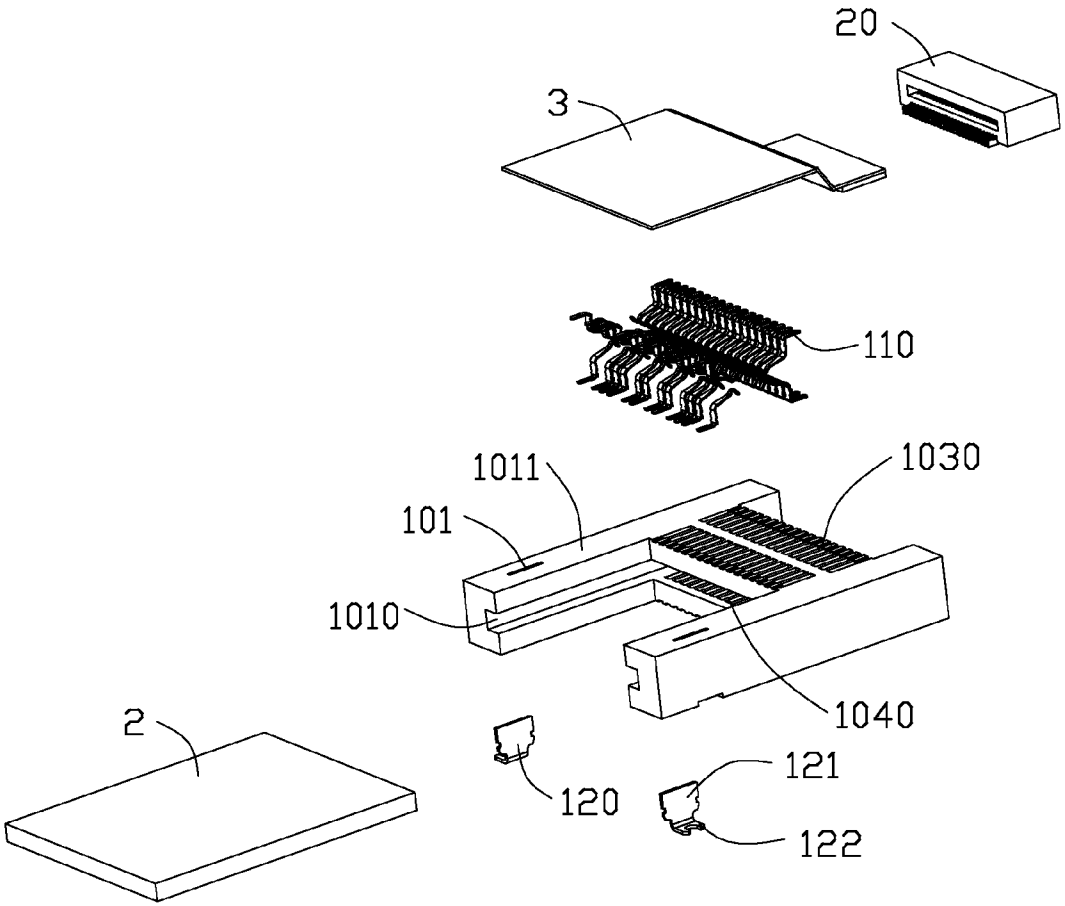
FIG. 3 is an exposed view of the electrical connector assembly shown in FIG. 1.

Referring to FIG. 2 and FIG. 3, the socket 10 includes an insulative housing 100 and a plurality of contacts 110. The insulative housing 100 is substantially configured with a U-shape which includes a pair of parallel lengthwise arms 101 and a main body 102 connecting and perpendicular to the lengthwise arms 101. The main body 102 includes an upper body 103 and lower body 104 stacked in a vertical direction. The upper body 103 and the lower body 104 define a receiving room 105 therebetween which is communicate with runners 1010 defined in the lengthwise arms 101. The receiving room 105 is used to receive a card 2 inserted into the insulative housing 100 along the runners 1010. The upper body 103 defines a plurality of upper passageways 1030 and the lower body 104 defines a plurality of lower passageways 1040. In the instant embodiment, the upper passageways 1030 and the lower passageways 1040 are disposed in two rows which are interlaced with each other and opposite to each other.

Referring to FIG. 3, the lengthwise arms 101 defines a pair of slot 1011 to receive two metal ears 120. Each metal ear 120 includes a retention portion 121 fixed in the slot 1011 and a tail portion 122 bent from the retention portion 121 used to soldering on the printed circuit board 1.

Figure 4:
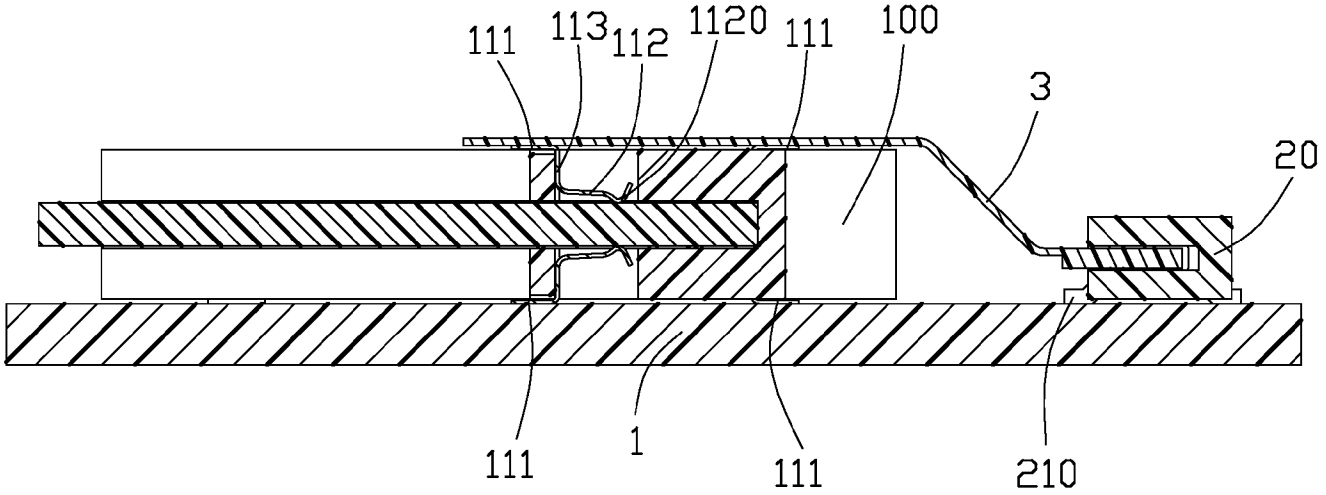
FIG. 4 is a cross-sectional view taken along line 4-4 of FIG. 1.

Referring to FIG. 3 and FIG. 4, the contacts 110 located in the upper passageways 1030 and the lower passageways 1040 are formed with the same configuration. Each contact 110 includes a soldering portion 111 with a flat structure, a spring portion 112, and a link portion 113 connecting the soldering portion 111 and the spring portion 112. The soldering portions 111 of the contacts 110 located in the upper passageways 1030 extend beyond a top surface of the insulative housing 100 and snug on the top surface of the insulative housing 100, and the soldering portions 111 of the contacts 110 located in the lower passageways 1040 extend beyond a bottom surface of the insulative housing 100 and snug on the bottom surface of the insulative housing 100. The link portions 113 are perpendicular to the soldering portions 111 and locate in the upper passageways 1030 or the lower passageways 1040, respectively. The spring portions 112 extend from the link portions 113 and have obtuse angle with the link portions 113. The spring portions 112 have mating portions 1120 to engage with two opposite sides of the card 2.

Referring to FIG. 4, the electrical connector assembly is used to electrically connect the card 2 and the printed circuit board 1. In the first embodiment, the socket 10 has the same structure contacts 110 located in an up-to-down direction and positioned face-to-face, the contacts 110 extending into the receiving room 105 to connect two opposite sides of the card 2. The soldering portions 111 of the contacts 110 extending beyond the bottom surface of the insulative housing 100 are used to solder on the printed circuit board 1. The soldering portions 111 extending beyond the top surface of the insulative housing 100 electrically connect a flex cable 3. The flex cable connector 20 includes terminals 210 electrically connecting the printed circuit board 1 and the flex cable 3.

Figure 5:
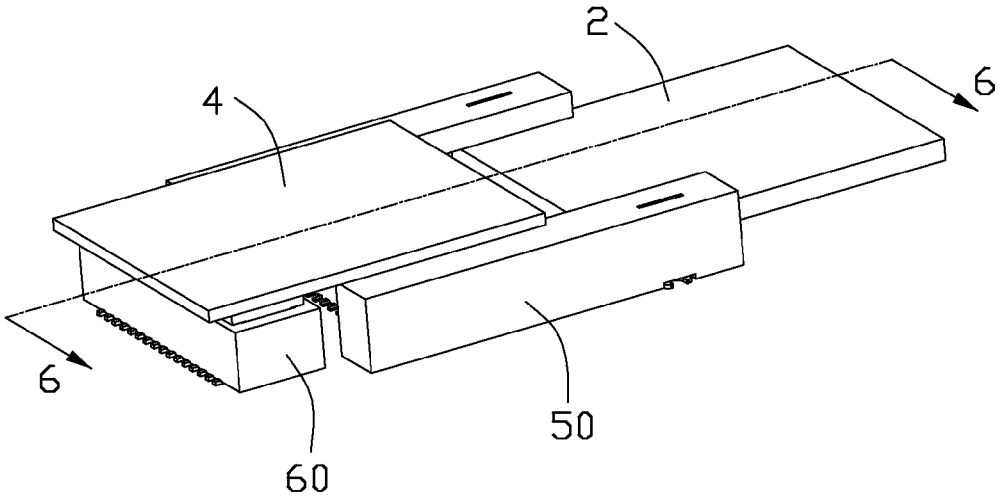
FIG. 5 is an assembled, perspective view of an electrical connector assembly in accordance with the second invention.
Figure 6:
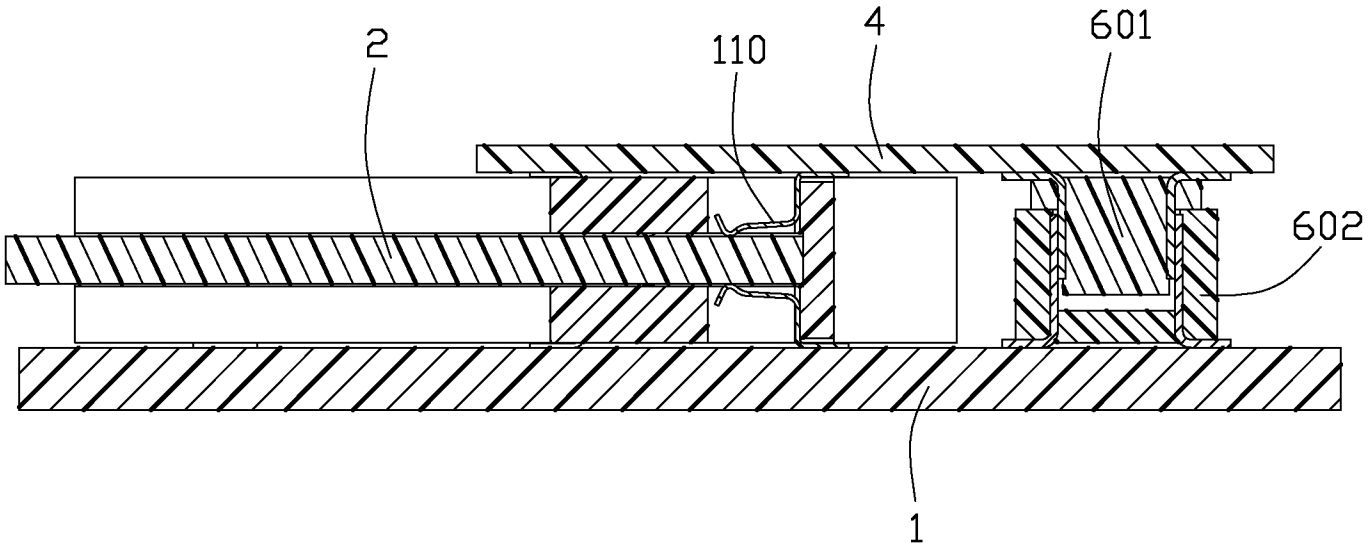
FIG. 6 is a cross-sectional view taken along line 6-6 of FIG. 5.

FIG. 5 and FIG. 6 show the second embodiment of the electrical connector assembly in accordance with the present invention, the electrical connector assembly includes a socket 50 and board-to-board connector 60. The socket 50 in this embodiment has a same structure with the socket 20 in the first embodiment. The board to board connector 60 includes a plug connector 601 and a receptacle connector 602 receiving the plug connector 601. The socket 50 and the board to board connector 60 are located between the printed circuit board 1 and a sub-circuit board 4. The sub-circuit board 4 electrically connects the socket 50 and the board to board 60. In this embodiment, the electrical connector assembly is used to electrical connect the card 2 and printed circuit board 1.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector assembly mounted on a printed circuit board, comprising:

a socket mounted on the printed circuit board, the socket having an insulative housing with upper body and lower body to form a receiving room;

a plurality of contacts respectively receiving in the upper body and lower body with a same structure, the contacts having spring portions extending into the receiving room and soldering portions extending out of a top surface of the upper body and a bottom surface of the lower body, respectively;

a connector mounted on the printed circuit board; and a linking element mechanically and electrically connecting the socket to the connector.

2. The electrical connector assembly as claimed in claim 1, wherein the contacts located in the upper body face to face the contacts located in the lower body in the receiving room.

3. The electrical connector assembly as claimed in claim 1, wherein the linking element mechanical is a flex cable.

4. The electrical connector assembly as claimed in claim 3, wherein the connector is a flex cable connector.

5. The electrical connector assembly as claimed in claim 4, wherein the flex cable connects the soldering portions of the contact located in the upper body and the flex cable connector.

6. The electrical connector assembly as claimed in claim 1, wherein the linking element mechanical is a sub-circuit board.

7. The electrical connector assembly as claimed in claim 6, wherein the connector is a board to board connector.

8. The electrical connector assembly as claimed in claim 7, wherein the sub-circuit board connects the soldering portions of the contact located in the upper body and the board to board connector.

9. An electrical connector assembly for receiving a card, comprising:

a socket connector including an insulative housing with a receiving room for electrically connecting two opposite sides of a card;

a plurality of contacts with a same structure disposed in the insulative housing and located in two rows in an up-to-down direction, the contacts extending into the receiving room adapt for connecting the card and extending beyond a top surface and a lower surface of the insulative housing;

a connector; and a linking element electrically connecting the contact beyond the connector and the upper surface of the insulative housing.

10. The electrical connector assembly as claimed in claim 9, wherein the contacts located in the upper position face to face the contacts located in the lower position in the receiving room.

11. The electrical connector assembly as claimed in claim 9, wherein the connector is a flex cable connector and the linking element is a flex cable.

12. The electrical connector assembly as claimed in claim 9, wherein the each contact includes a soldering portion with a flat structure snug on surface of the insulative housing, a spring portion extending into the receiving room, and a link portion extending along the up-to-down direction and connecting the soldering portion and the spring portion.

13. The electrical connector assembly as claimed in claim 9, wherein the connector is a board to board connector and the linking element is a sub-circuit board.

14. The electrical connector assembly as claimed in claim 13, wherein the socket and the connector are both mounted between a printed circuit board and the sub-circuit board.

15. An electrical connector assembly comprising:

a printed circuit board;

a primary connector mounted upon the printed circuit board, said primary connector defining a horizontal receiving slot communicating forwardly with an exterior in a front-to-back direction to receive a primary printed circuit board, a plurality of upper and lower first contacts disposed in the housing by two opposite sides of the receiving slot in a vertical direction with corresponding first contacts sections extending into the receiving slot and first tail sections located upon opposite upper and bottom faces of the housing; and a secondary connector mounted upon the printed circuit board behind the primary connector with therein second contacts, each of said second contacts including a second tail section mounted upon the printed circuit board and a second contacting section exposed for coupling; wherein a secondary printed circuit board mounted upon the upper face with a front region mechanically and electrically connected with the first tail sections of the upper first contacts and a rear region mechanically and electrically connected to the second contacting sections of the second contacts.

16. The electrical connector assembly as claimed in claim 15, wherein the primary connector is configured to have the upper first contacts assembled downwardly from the upper face and have the lower first contacts assembled upwardly from the bottom face.

17. The electrical connector assembly as claimed in claim 15, wherein the secondary connector includes upper and lower parts mated with each other each having corresponding upper and lower second terminals, and the second tail sections are formed on the lower terminals while the second contacting sections are formed on the upper terminals.

18. The electrical connector assembly as claimed in claim 17, wherein said secondary printed circuit board is rigid.

19. The electrical connector assembly as claimed in claim 15, wherein said secondary printed circuit board is flexible.

20. The electrical connector assembly as claimed in claim 19, wherein said secondary connector defines a slot to receive the rear region of the secondary connector.

* * * * *